United States Patent [19]

Kanzaka

[11] Patent Number: 4,457,050

[45] Date of Patent: Jul. 3, 1984

[54] SNAP-FIT BUTTON

[75] Inventor: Yoshihiro Kanzaka, Nyuzen, Japan

[73] Assignee: Yoshida Kogyo K.K., Tokyo, Japan

[21] Appl. No.: 345,027

[22] Filed: Feb. 2, 1982

[30] Foreign Application Priority Data

Feb. 6, 1981 [JP] Japan ..... 56-15493[U]

[51] Int. Cl.[3] ..... A44B 1/38

[52] U.S. Cl. ..... 24/108; 24/453

[58] Field of Search ..... 24/108, 113 R, 113 MP, 24/90 A, 90 C, 208 A, 216, 90 E, 101 R, 214, 213 R, 662, 691, 696

[56] References Cited

U.S. PATENT DOCUMENTS

| | | | |
|---|---|---|---|
| 2,538,396 | 1/1951 | Sutin | 24/216 |
| 2,548,104 | 4/1951 | Frison | 24/216 |
| 2,996,777 | 8/1961 | Mishkin | 24/108 |
| 3,107,408 | 10/1963 | Huelster et al. | 24/208 A |
| 3,210,820 | 10/1965 | Humiston | 24/208 A |
| 3,551,963 | 1/1971 | Mosher, Jr. et al. | 24/216 |
| 3,925,860 | 12/1975 | Furuya | 24/208 A |
| 3,934,314 | 1/1976 | Whysall | 24/113 R |
| 4,050,120 | 9/1977 | Yamaguchi | 24/208 A |
| 4,253,226 | 3/1981 | Takeda | 24/208 A |

FOREIGN PATENT DOCUMENTS

| | | | |
|---|---|---|---|
| 5146501 | 10/1974 | Japan . | |
| 65394 | 12/1913 | Sweden | 24/108 |
| 855945 | 12/1960 | United Kingdom | 24/208 A |

*Primary Examiner*—Mickey Yu

*Attorney, Agent, or Firm*—Bucknam and Archer

[57] ABSTRACT

A button assembly is disclosed for attachment on a garment fabric, which assembly comprises a female or button part having an apertured shank and a male or fastener part having a pointed shank for insertion into the aperture of the female shank. The button assembly is provided with means for expelling the air entrapped within the aperture of the female shank which would otherwise cause rupture of the button part.

7 Claims, 12 Drawing Figures

SNAP-FIT BUTTON

BACKGROUND OF THE INVENTION

1. Field of the Invention

This invention relates to a button assembly having a male and a female part which are adapted to be mounted with a snap fit on a fabric article.

2. Prior Art

There are known certain button assemblies of the type referred to herein as disclosed for example in U.S. Pat. No. 2,996,777 which comprise a female part having a cylindrical shank and a male or fastener part having a pointed shank for insertion through a garment fabric into the aperture in the female shank. A similar button device is disclosed in Japanese Laid-Open Utility Model Publication No. 51-46501. The prior art button assemblies have a drawback in that when the male shank is pushed through the fabric into the female aperture, there is a tendency of air being trapped and compressed within the aperture with the results that a muscular effort is required to couple the two parts together which would often in turn cause the female button part to be ruptured.

SUMMARY OF THE INVENTION

With the foregoing drawback in view, the present invention provides an improved button assembly which comprises a female part or button and a male part or a fastener having a centrally projecting shank, said female part being centrally apertured to receive said shank, and means provided in the fastener for allowing the air entrapped in the aperture to escape therefrom when the two parts are coupled together or assembled.

Other objects and features of the invention include the provision of a button assembly of the type referred to herein which is relatively simple in construction and hence less costly to make than the prior assemblies, mechanically strong against deformation and yet easy to be assembled.

The invention will be better understood from reading the following description of certain preferred embodiments taken in connection with the accompanying drawings.

DETAILED DESCRIPTION OF THE PREFERRED EMBODIMENTS

Figure 1:
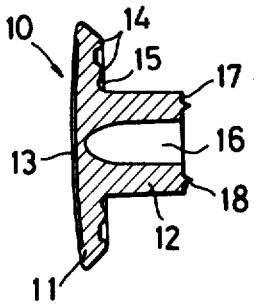
FIG. 1 is a vertical cross-sectional view of a base plate constituting one or female part of a button assembly according to the invention.
Figure 2:
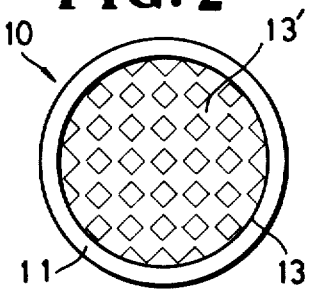
FIG. 2 is a plan view of the front of the base plate shown in FIG. 1.
Figure 3:
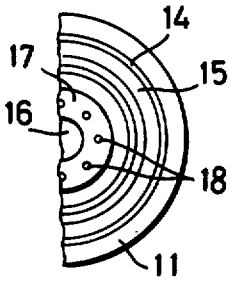
FIG. 3 is a partly broken away plan view of the rear of the base plate.

Referring now to the drawings and FIGS. 1 and 2 in particular, there is shown a female part, commonly known as a button 10 constituting one or button part of a button assembly according to the invention, which female part 10 has a base plate 11 generally in the form of a circular disc as viewed in plan (see FIG. 2) and a female shank 12 extending integrally with and at right angles to the plane of the base plate 11. The base plate 11 has mounted on its front surface a decorative disc 13 of any suitable pattern or design 13' to give rise to an aesthetic appeal. On the opposite or rear surface of the plate 11, there are provided alternate annular ridges 14 and grooves 15 as shown in FIGS. 1 and 3, the number of said ridges and grooves being dependent upon the size of the plate 11 to ensure sufficient mechanical strength against deformation or damage under the influence of external stresses. The female shank 12 has an axial bore 16 open at one end and extending at the other end into the web of the plate 11. The shape of the bore 16 is generally complementary with that of a male shank later to be described. The shank 12 has at its end periphery 17 a plurality of circumferentially spaced prongs 18 which bite into a garment fabric F (FIG. 6) and anchor the female part or button 10 in place in cooperation with the male part.

Figure 4:
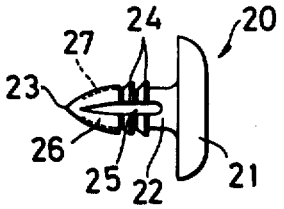
FIG. 4 is a side elevational view of a fastener constituting the other or male part of the button assembly according to the invention.
Figure 6:
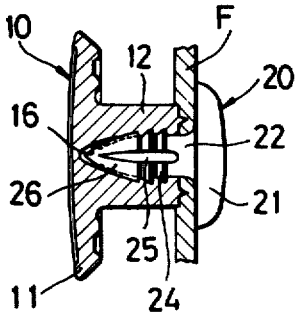
FIG. 6 is a view similar to FIG. 1 of the female part engaged across a garment fabric with the male part of FIG. 4.

Turning now to FIG. 4, there is shown a male part, commonly known as a fastener 20, sometimes called a butt constituting the other or fastener part of the assembly. The fastener 20 is generally in the form of a rivet having an enlarged circular head 21 and a male shank 22 extending centrally therefrom and pointed as at 23 to enable the shank 22 to thrust though the garment fabric F. The male shank 22 is shaped generally complementarily with the contour of the axial bore 16 of the female part or button 10 so that it can be received therein when the two parts of the assembly are coupled together as shown in FIG. 6. The male shank 22 has an outside diameter slightly larger than the inside diameter or bore size of the axial bore 16 and preferably has a plurality of generally saw-toothed annular ribs 24 so that the ribs 24 can intrude into the inner peripheral wall defining the bore 16 when assembling the fastener 20 with the button 10 as illustrated in FIG. 6. For this purpose, both parts 10 and 20 of the assembly are preferably made of a plastic material. Alternatively, the part 10 may be plastic while the part 20 is metallic. Further alternatively, the parts 10 and 20 may be both made of aluminum.

Figure 5:
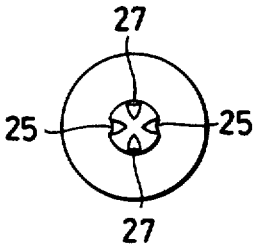
FIG. 5 is a plan view of the rear of the fastener shown in FIG. 4.

According to an important feature of the invention, the male shank 22 of the fastener 20 is provided with at least one axial slot 25, or preferably diametrically opposed axial slots or recesses 25 as shown in FIGS. 4, 5 and 6, each of which slots 25 extends across the ribs 24 and along a substantial length of the male shank 22. The air entrapped within the bore 16, when the button 10 and the fastener 20 are coupled together, can be released and expelled through the slots 25 in the fastener 20 to the atmosphere.

According to another feature of the invention, the fastener 20 is provided at its conical end portion 26 with a plurality of circumferentially spaced grooves 27, some of which are merged with the axial slots 25 as better shown in FIG. 5. These grooves 27 cooperatively with the slots 25 serve to reduce frictional resistance of the fastener shank 22 with respect to the garment fabric F and thus facilitate insertion of the shank 22 therethrough.

Figure 7:
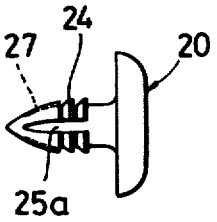
FIGS. 7 and 8 are side elevations of two modifications of the fastener shown in FIG. 4.

FIG. 7 shows a modification 25*a* of the axial slot 25 of the fastener 20. This modified slot 25*a* is formed only in and across the ribs 24 and merged with the groove or grooves 27.

Figure 8:
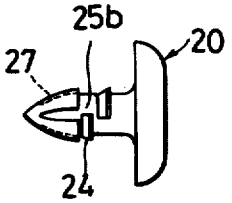

FIG. 8 shows another modification which is a meander slot 25*b* resulting from cutting away a portion of each of the ribs 24 in alternate positions, the slot 25*b* being also merged with the groove 27.

Figure 9:
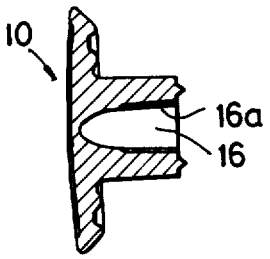
FIG. 9 is a view similar to FIG. 1 but showing a modification of the female part.

FIG. 9 shows a modification of the female part or button 10 wherein there is provided at least one slot 16*a* formed in the inner peripheral wall defining the bore 16, which slot 16*a* has the same function of air expulsion as the slots 25 in the fastener 20.

Figure 10:
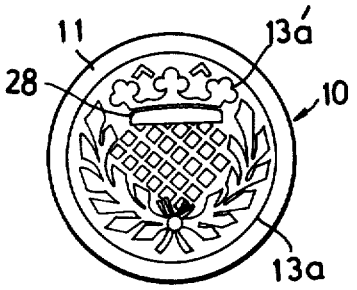
FIGS. 10, 11 and 12 inclusive are views provided to illustrate a further embodiment of the invention which has means indicating the position in which the button is mounted relative to a given fabric article.
Figure 11:
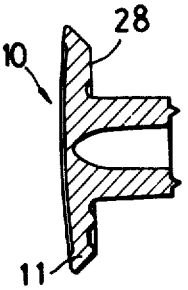
Figure 12:
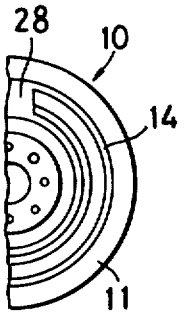

FIGS. 10, 11 and 12 inclusive illustrate an example of a modification of the button assembly embodying the invention. The decorative disc 13*a* shown in FIG. 10 carries a design pattern 13*a*' drawn as a marking to direct the position in which the button 10 is to be mounted. FIGS. 11 and 12, respectively, show the button 10 which has one of its ridges 14 partially cut away as at 28 to form a marking indicative of the position in which the button 10 is to be mounted with respect to the garment fabric F.

From the foregoing the artisan will appreciate that the invention provides; a button comprising: a button part including a base and a female shank extending from said base and having an axial bore therein, and a fastener part having a head and a male shank extending from said head and adapted to fit forcibly into said axial bore in said female shank, one of said female shank and said male shank having means for allowing air to escape from said axial bore when said male shank is forced into said axial bore.

While many other modifications and changes may be made by those versed in the art, it should be understood that I wish to embody within the scope of the patent warranted hereon, all such embodiments as reasonably and properly come within the scope of my contribution to the art.

What is claimed is:

1. A button comprising:

(a) a button part including a base and a female shank extending from said base and having therein an axial bore open at one end and extending at the other end into said base, said other end being closed;

(b) a fastener part having a head and a male shank extending from said head and adapted to fit forcibly into said axial bore in said female shank, said male shank being complementary in shape to said axial bore and having an enlarged conical end portion, said conical end portion having a maximum free diameter larger than the inside diameter of said axial bore; and (c) one of said female shank and said male shank having passage means for allowing air to escape from said axial bore when said male shank is forced axially into said bore, said passage means comprising at least one slot extending axially in said female shank and opening into said axial bore in said female shank.

2. A button comprising:

(a) a button part including a base and a female shank extending from said base and having therein an axial bore open at one end and extending at the other end into said base, said other end being closed;

(b) a fastener part having a head and a male shank extending from said head and adapted to fit forcibly into said axial bore in said female shank, said male shank being complementary in shape to said axial bore and having an enlarged conical end portion, said conical end portion having a maximum free diameter larger than the inside diameter of said axial bore; and (c) one of said female shank and said male shank having passage means for allowing air to escape from said axial bore when said male shank is forced axially into said bore, said passage means comprising at least one slot extending axially in said male shank.

3. A button comprising:

(a) a button part including a base and a female shank extending from said base and having therein an axial bore open at one end and extending at the other end into said base, said other end being closed;

(b) a fastener part having a head and a male shank extending from said head and adapted to fit forcibly into said axial bore in said female shank, said male shank being complementary in shape to said axial bore and having an enlarged conical end portion, said conical end portion having a maximum free diameter larger than the inside diameter of said axial bore; and (c) one of said female shank and said male shank having passage means for allowing air to escape from said axial bore when said male shank is forced axially into said bore, said passage means comprising at least one groove extending axially in said conical end portion.

4. A button comprising:

(a) a button part including a base and a female shank extending from said base and having therein an axial bore open at one end and extending at the other end into said base, said other end being closed;

(b) a fastener part having a head and a male shank extending from said head and adapted to fit forcibly into said axial bore in said female shank, said male shank being complementary in shape to said axial bore and having an enlarged conical end portion, said conical end portion having a maximum free diameter larger than the inside diameter of said axial bore; and (c) one of said female shank and said male shank having passage means for allowing air to escape from said axial bore when said male shank is forced axially into said bore, said passage means comprising at least one slot extending axially in said male shank, and at least one groove extending axially in said conical end portion, said groove being merged with said slot.

5. A button comprising:

(a) a button part including a base and a female shank extending from said base and having therein an axial bore open at one end and extending at the other end into said base, said other end being closed;

(b) a fastener part having a head and a male shank extending from said head and adapted to fit forcibly into said axial bore in said female shank, said male shank being complementary in shape to said axial bore and having an enlarged conical end portion and a plurality of annular locking ribs, said conical end portion having a maximum free diameter larger than the inside diameter of said axial bore; and (c) one of said female shank and said male shank having passage means for allowing air to escape from said axial bore when said male shank is forced axially into said bore, said passage means comprising at least one slot extending axially in said male shank across said ribs.

6. A button comprising:

(a) a button part including a base and a female shank extending from said base and having therein an axial bore open at one end and extending at the other end into said base, said other end being closed;

(b) a fastener part having a head and a male shank extending from said head and adapted to fit forcibly into said axial bore in said female shank, said male shank being complementary in shape to said axial bore and having an enlarged conical end portion and a plurality of annular locking ribs, said conical end portion having a maximum free diameter larger than the inside diameter of said axial bore; and (c) one of said female shank and said male shank having passage means for allowing air to escape from said axial bore when said male shank is forced axially into said bore, said passage means comprising at least one axial slot formed only in and across said annular ribs.

7. A button according to claim 6, said axial slot being of a meander form resulting from cutting away a portion of each of said annular ribs.

* * * * *